US010208694B2

(12) United States Patent
Han

(10) Patent No.: US 10,208,694 B2
(45) Date of Patent: Feb. 19, 2019

(54) CONTROL METHOD FOR DUAL INJECTOR OF ENGINE

(71) Applicant: HYUNDAI MOTOR COMPANY, Seoul (KR)

(72) Inventor: Min-Kyu Han, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 134 days.

(21) Appl. No.: 15/371,499

(22) Filed: Dec. 7, 2016

(65) Prior Publication Data

US 2018/0045132 A1 Feb. 15, 2018

(30) Foreign Application Priority Data

Aug. 11, 2016 (KR) ..... 10-2016-0102264

(51) Int. Cl.

| | |
|---|---|
| ***F02D 41/22*** | (2006.01) |
| ***F02M 51/00*** | (2006.01) |
| ***F02D 41/30*** | (2006.01) |
| ***F02D 41/38*** | (2006.01) |
| *F02D 41/20* | (2006.01) |

(52) U.S. Cl.

CPC ..... *F02D 41/221* (2013.01); *F02D 41/3094* (2013.01); *F02D 41/38* (2013.01); *F02M 51/005* (2013.01); *F02D 2041/2089* (2013.01); *F02D 2041/2093* (2013.01); *F02D 2041/224* (2013.01); *F02D 2041/227* (2013.01); *F02D 2041/389* (2013.01)

(58) Field of Classification Search

CPC .... F02D 41/221; F02D 41/3094; F02D 41/38; F02D 2041/224; F02D 2041/227; F02D 2041/389; F02D 41/22; F02D 2041/2089; F02D 41/20; F02D 19/0623; F02D 2041/2093; F02D 41/34; F02D 19/061; F02D 19/0689; F02D 41/30; F02D 2041/226; F02D 19/024; F02M 51/005; F02M 63/0225; Y02T 10/44; Y02T 10/123

USPC ..... 123/299, 479, 490; 701/103, 107

See application file for complete search history.

(56) References Cited

U.S. PATENT DOCUMENTS

| | | | | |
|---|---|---|---|---|
| 6,276,472 | B1 * | 8/2001 | Takashima | B60W 10/06 180/65.21 |
| 7,370,638 | B2 * | 5/2008 | Hayakawa | F02D 41/221 123/467 |

(Continued)

FOREIGN PATENT DOCUMENTS

| | | | |
|---|---|---|---|
| JP | H09151767 | A | 6/1997 |
| JP | 2009203884 | A | 9/2009 |

(Continued)

*Primary Examiner* — Thomas Moulis
*Assistant Examiner* — John Bailey
(74) *Attorney, Agent, or Firm* — McDonnell Boehnen Hulbert & Berghoff LLP

(57) ABSTRACT

A method for controlling a plurality of injectors installed in the same cylinder of an engine may include determining whether an electrical failure occurred in any of the injectors, and entering a fail-safe mode when an electrical failure has occurred only in one of the plurality of injectors in the same cylinder. In the fail-safe mode, fuel supply to an injector that has experienced an electrical failure is cut off, and the amount of fuel injected into the cylinder by a normally operating injector is increased.

6 Claims, 7 Drawing Sheets

(56) References Cited

U.S. PATENT DOCUMENTS

| | | | | |
|---|---|---|---|---|
| 7,933,710 | B2 * | 4/2011 | Tanaka | F02D 41/1495 701/103 |
| 8,989,988 | B2 * | 3/2015 | Nishikiori | F02D 13/0207 123/482 |
| 2001/0027769 | A1 * | 10/2001 | Mizuno | F02B 31/085 123/295 |
| 2002/0117939 | A1 * | 8/2002 | Kawamoto | F02D 41/2096 310/316.03 |
| 2005/0126542 | A1 * | 6/2005 | Oono | F02D 41/20 123/479 |
| 2007/0125343 | A1 * | 6/2007 | Hayakawa | F02D 41/221 123/447 |
| 2008/0249699 | A1 * | 10/2008 | Wolber | F02D 41/221 701/107 |
| 2009/0198434 | A1 * | 8/2009 | Tanaka | F02D 41/1495 701/103 |
| 2009/0216429 | A1 * | 8/2009 | Yamashita | F02D 13/0226 701/107 |
| 2014/0163843 | A1 * | 6/2014 | Kojima | F02D 41/20 701/107 |
| 2016/0273472 | A1 * | 9/2016 | Ariie | F02D 19/0623 |

FOREIGN PATENT DOCUMENTS

| | | | |
|---|---|---|---|
| JP | 2014098343 | A | 5/2014 |
| JP | 2015203380 | A | 11/2015 |
| KR | 10-1393896 | B1 | 5/2014 |

* cited by examiner

CONTROL METHOD FOR DUAL INJECTOR OF ENGINE

CROSS-REFERENCE(S) TO RELATED APPLICATIONS

This application claims priority to Korean Patent Application No. 10-2016-0102264, filed on Aug. 11, 2016, which is incorporated herein by reference in its entirety.

BACKGROUND OF THE INVENTION

Field of the Invention

The present invention relates to a method for controlling a fuel injector of an engine, and more particularly, to a method for controlling fuel injection of a dual injector supplying fuel into a cylinder of an engine when an electrical failure occurs in at least one of the injectors of the dual injector.

Description of Related Art

In a typical engine, only one injector is installed at an intake port. In particular, a Multi-Point Injection ("MPi") engine includes a fuel injection valve installed at each cylinder such that an intake manifold of the cylinder injects fuel in advance. The MPi engine includes two intake valves and two exhaust values per cylinder. The MPi engine maintains a system that has one injector to inject fuel, while two intake valves are used.

In the case of a dual port injector engine, such as the engine disclosed in Korean Patent No. 10-1393896, two injectors are configured to inject fuel into the same cylinder. When the dual port injector is used, the volumetric efficiency can be improved to increase the fuel efficiency while reducing harmful exhaust emissions.

In the conventional dual port injector engine, however, when an electrical failure occurs in one of the injectors of a specific cylinder, fuel supply to the corresponding cylinder is stopped, in a condition known as a fuel cut. As a result, 25% of the entire torque of the vehicle is immediately reduced. Therefore, while feeling a sense of incompatibility, a driver may experience difficulty in driving the vehicle to a repair shop to repair the injector.

SUMMARY OF THE INVENTION

The present invention is directed to a control method for a dual injector engine that is capable of preventing a reduction of torque in a corresponding cylinder when an electrical failure occurs in one of the injectors, thereby enabling a driver to safely drive a vehicle to a repair shop without feeling a sense of incompatibility.

Other objects and advantages of the present invention can be understood by the following description, and become apparent with reference to the embodiments of the present invention. Those skilled in the art to which the present invention pertains will appreciate that the objects and advantages of the present invention can be realized by the means as claimed and combinations thereof.

In accordance with an embodiment of the present invention, there is provided a method for controlling a plurality of injectors installed in the same cylinder, including: determining whether an electrical failure has occurred in any of injectors; and entering a fail-safe mode when an electrical failure occurred only in one of the injectors of the plurality of injectors. In the fail-safe mode, fuel supply to an injector that has experienced an electrical failure may be cut off, and the amount of fuel injected into the cylinder by a normally operating injector may be increased.

Entering the fail-safe mode may further include: determining the cause of the electrical failure; and depending on the cause of the electrical failure deciding whether to cut off the fuel supply to the injector that has experienced an electrical failure and to perform injection control for that injector to inject fuel.

When the total amount of fuel required by the corresponding cylinder is equal to or more than the flow rate of the normally operating injector, fuel supply to all injectors in the same cylinder may be cut off.

When the cause of the electrical failure is a short circuit between an injector and a ground, fuel supply to all injectors may be cut off.

When the cause of the electrical failure is either a short circuit between an engine control unit ("ECU") driver and a battery or an open circuit between the ECU driver and one of the injectors, the fuel supply to the injector that has experienced an electrical failure may be cut off, and the amount of fuel injected by the normally operating injector may be increased, in order to perform injection control.

When it is determined that electrical failures have occurred in all injectors in the same cylinder, fuel supply to all injectors may be cut off.

When entering the fail-safe mode, the engine may be operated in a limp home mode, i.e. a mode in which torque and engine RPM are limited.

DESCRIPTION OF SPECIFIC EMBODIMENTS

Exemplary embodiments of the present disclosure are described in detail with reference to the accompanying drawings. The same reference numbers are used throughout the drawings to refer to the same or like parts. Detailed descriptions of well-known functions and structures incorporated herein may be omitted to avoid obscuring the subject matter of the present disclosure. Other exemplary embodiments or features may further be utilized, and other changes may be made, without departing from the scope of the subject matter presented herein. The exemplary embodiments described herein are not meant to be limiting. Thus, aspects of the present disclosure, as generally described herein and illustrated in the figures, can be arranged, substituted, combined, separated and designed in a wide variety of different configurations, all of which are explicitly contemplated herein.

Figure 1A:
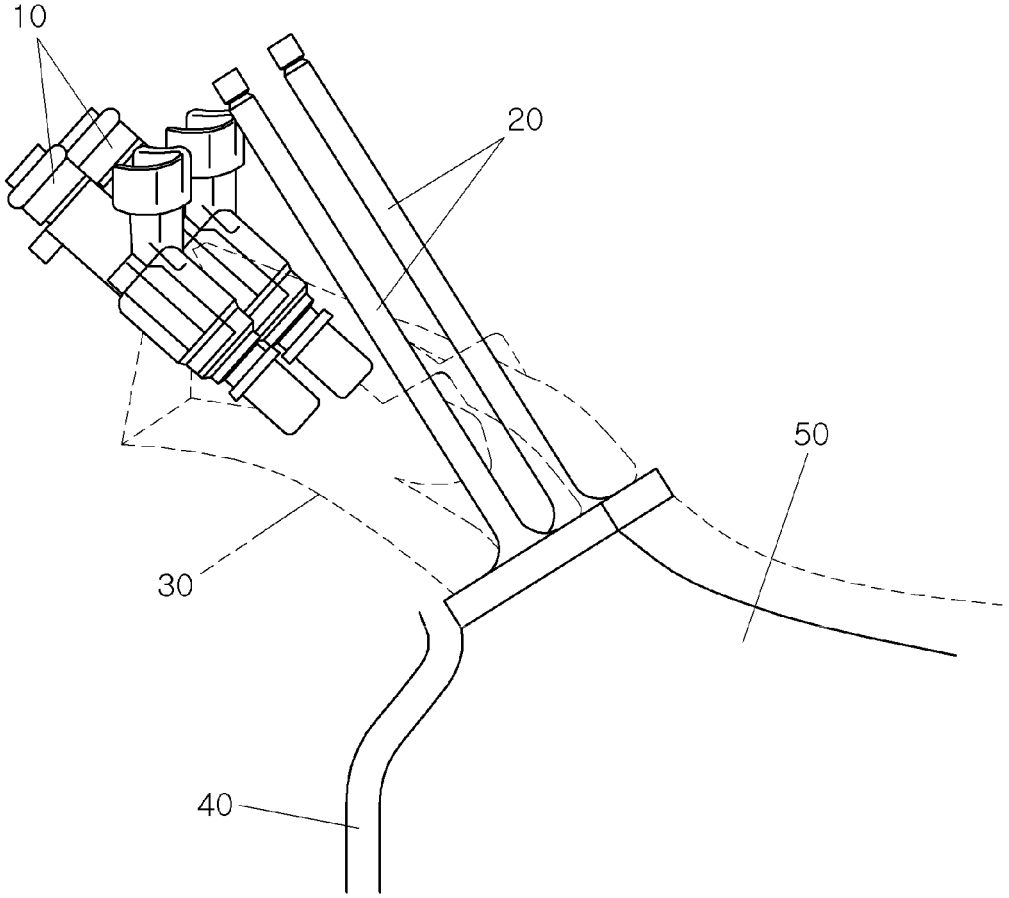
FIGS. 1A and 1B are a diagram illustrating intake ports of an engine including a dual port injector and a diagram illustrating a block diagram to which the present invention is applied.
Figure 1B:
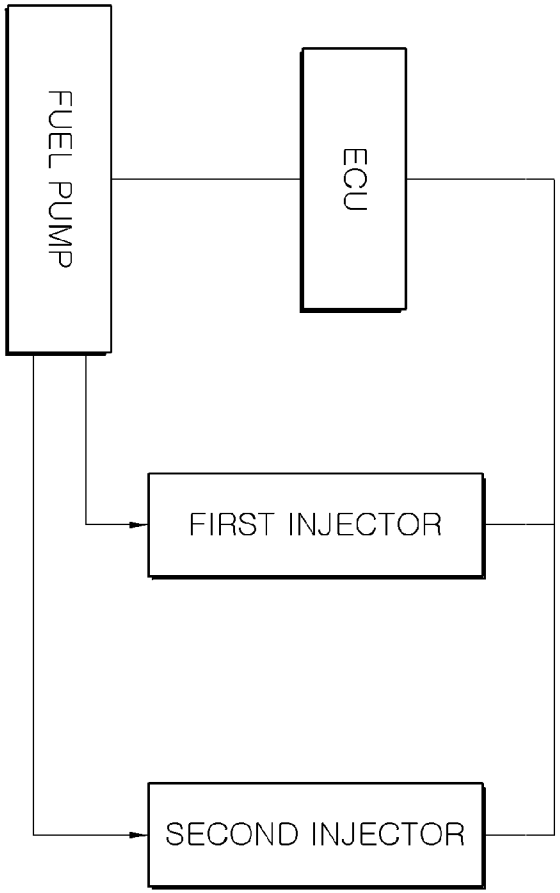

FIG. 1A is a diagram illustrating intake ports of a dual port injector engine controlled by a control method in accordance with an embodiment of the present invention. Referring to FIG. 1A, each cylinder of the engine includes two intake ports 30 communicating with a combustion chamber, and each of the intake ports 30 has an intake valve 20 for opening and closing the respective intake port 30. At the rear of each of the intake valves 20, an injector 10 is installed. Thus, a plurality of injectors 10 is installed.

According to the above-described configuration, each injector 10 injects fuel into a respective intake port 30 in the same cylinder. The fuel injected into the intake ports 30 is mixed with the air and supplied as a gas mixture into the combustion chamber.

The example control method for the dual injector of an engine can be applied to the dual port injector described above. Further, the example control method for the dual injector of an engine can be applied to a dual injector in which one injector injects fuel into the intake port and the other injector injects fuel directly into a cylinder, or two direct injection injectors.

Figure 2A:
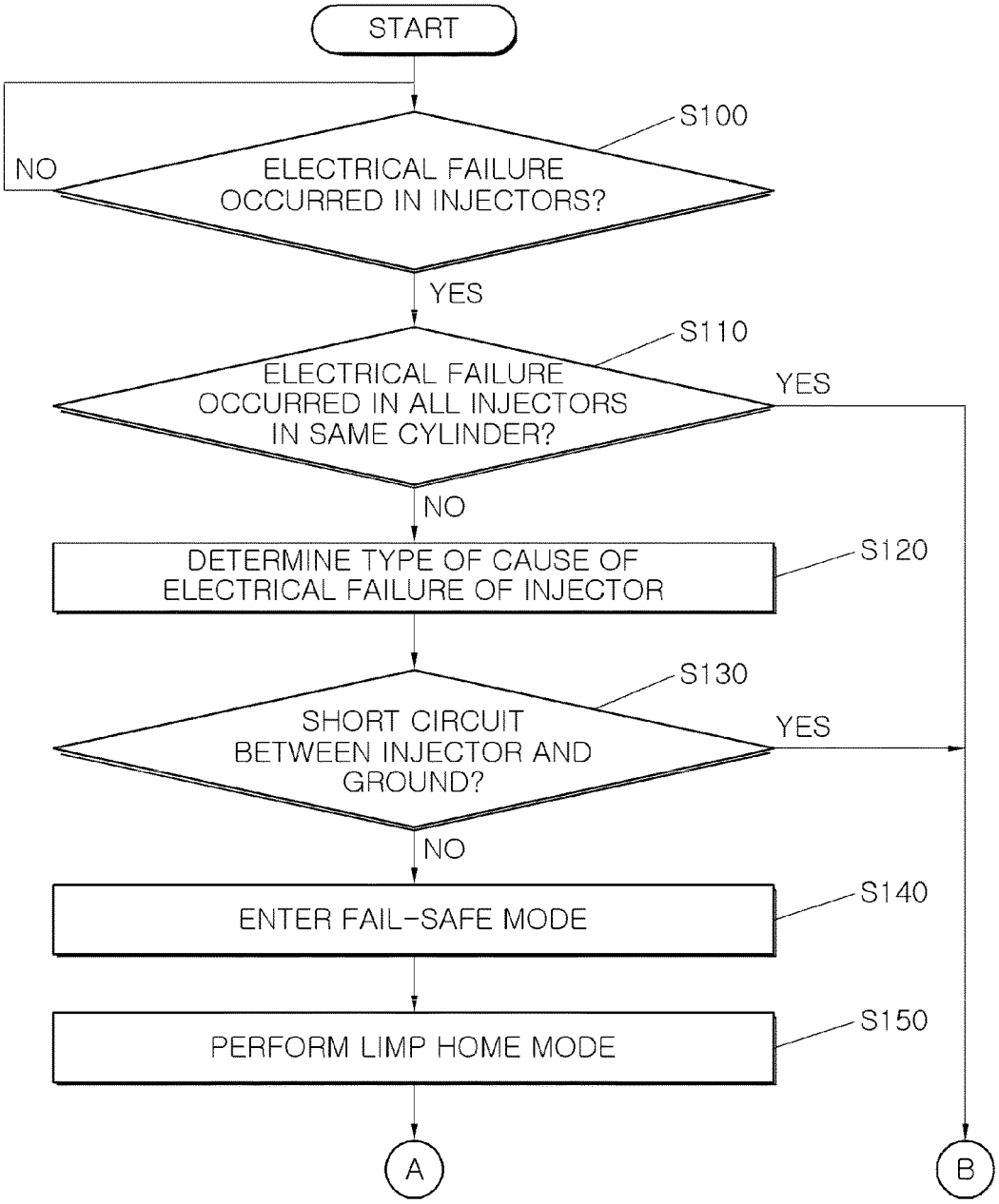
FIGS. 2A and 2B is a flowchart illustrating a control method for a dual injector of an engine in accordance with an embodiment of the present invention.
Figure 2B:
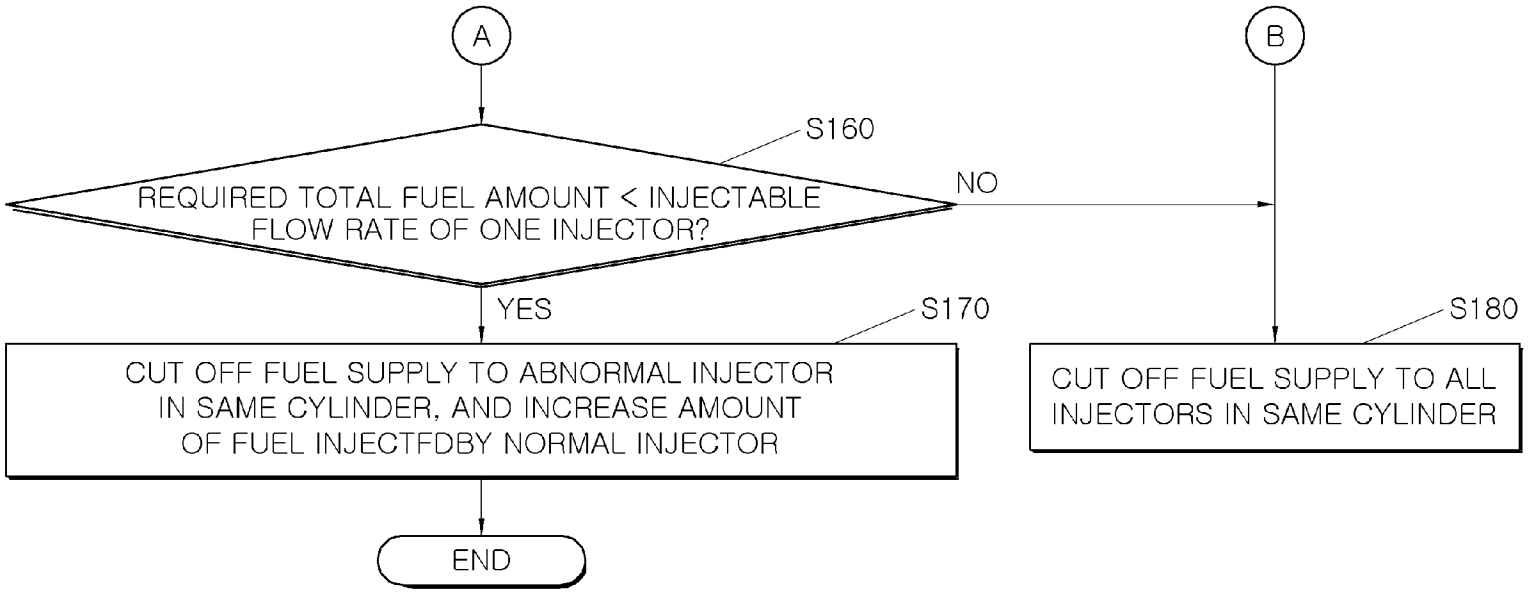

FIGS. 2A and 2B depict a flowchart illustrating an example control method for a dual injector of an engine. FIGS. 2A and 2B show the control method for injecting fuel from a dual injector into a corresponding cylinder when an electrical failure occurs in one of the injectors included in a dual injector engine.

At step S100, an ECU determines whether an electrical failure has occurred in the injectors. Preferably, the ECU can determine whether an electrical failure has occurred by a fail diagnosis method through the fail diagnosis information provided by a power system using an Application-Specific Integrated Circuit ("ASIC") installed in the system of the ECU that drives and controls the injectors 10.

At step S110, the ECU determines whether an electrical failure occurred in one or all injectors, according to the fail diagnosis method. A normally operating injector is an injector that has not experienced an electrical failure and can inject the appropriate amount of fuel into the cylinder. The ECU determines whether such an injector exists.

When the ECU determines that an electrical failure occurred in one of the injectors, the ECU performs a fail safe mode at steps S170 as below.

An injector in which an electrical failure has occurred may be referred to herein as an abnormally operating injector. Specifically, the ECU controls a fuel pump to stop the fuel supply to an abnormally operating injector, a condition referred to as a fuel cut. The ECU also increases the amount of fuel that the normally operating injector injects so that the amount of fuel required in the corresponding cylinder can be supplied to the cylinder only by the normally operating injector.

In this case, the normally operating injector can provide the amount of fuel required by the corresponding cylinder, that is, the amount of fuel that would have been supplied by both injectors 10 operating under normal conditions. Thus, a reduction of engine torque that occurs when the fuel supply to all injectors in the corresponding cylinder is cut off is avoided. Therefore, even when a failure occurs in one injector, a driver can drive the vehicle to a repair shop to repair the injector, without feeling a sense of incompatibility.

When the ECU determines that an electrical failure has occurred in all injectors, fuel cannot be normally supplied to the corresponding cylinder because no normally operating injectors exist. Thus, the fuel supply to all injectors of the corresponding cylinder is cut off at step S180.

In the embodiment of the present invention, the ECU may determine the cause of the failure in the injector 10 at step S120, and decide whether to enter the fail safe mode. Preferably, the ECU may determine the cause of the failure in the injector, using the ASIC installed in the system of the ECU that drives and controls the injector.

Figure 3A:
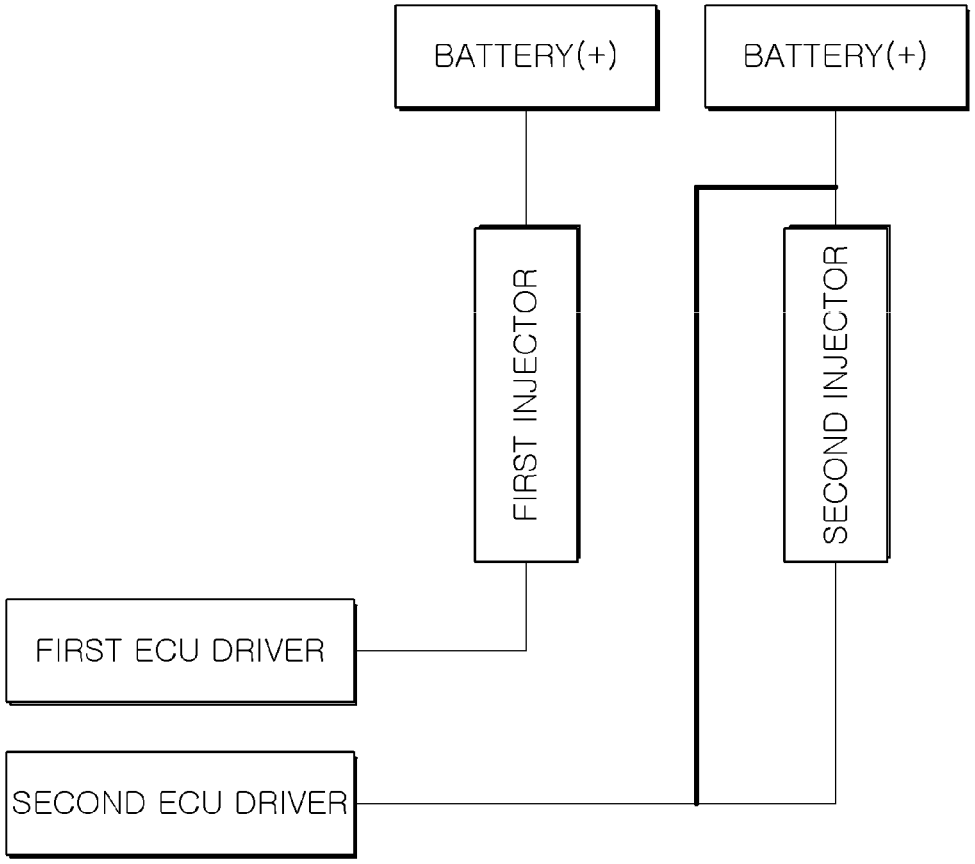
FIGS. 3A to 3C are diagrams illustrating the types of causes of electrical failures that may occur in a dual injector.
Figure 3B:
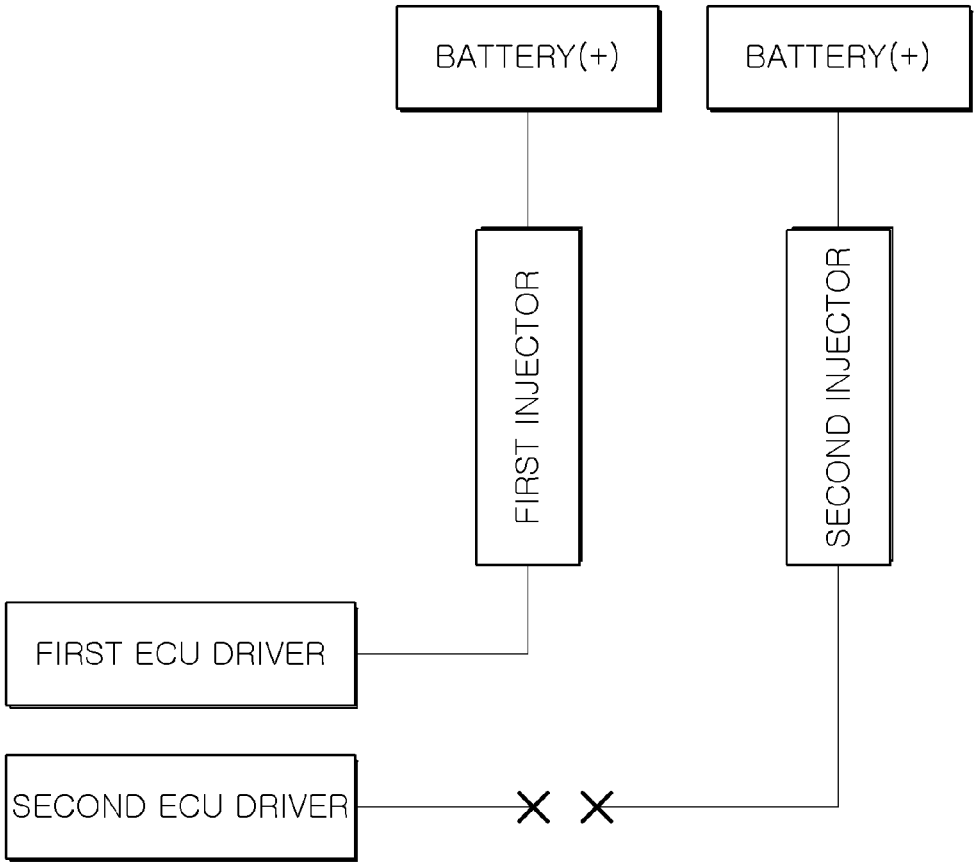
Figure 3C:
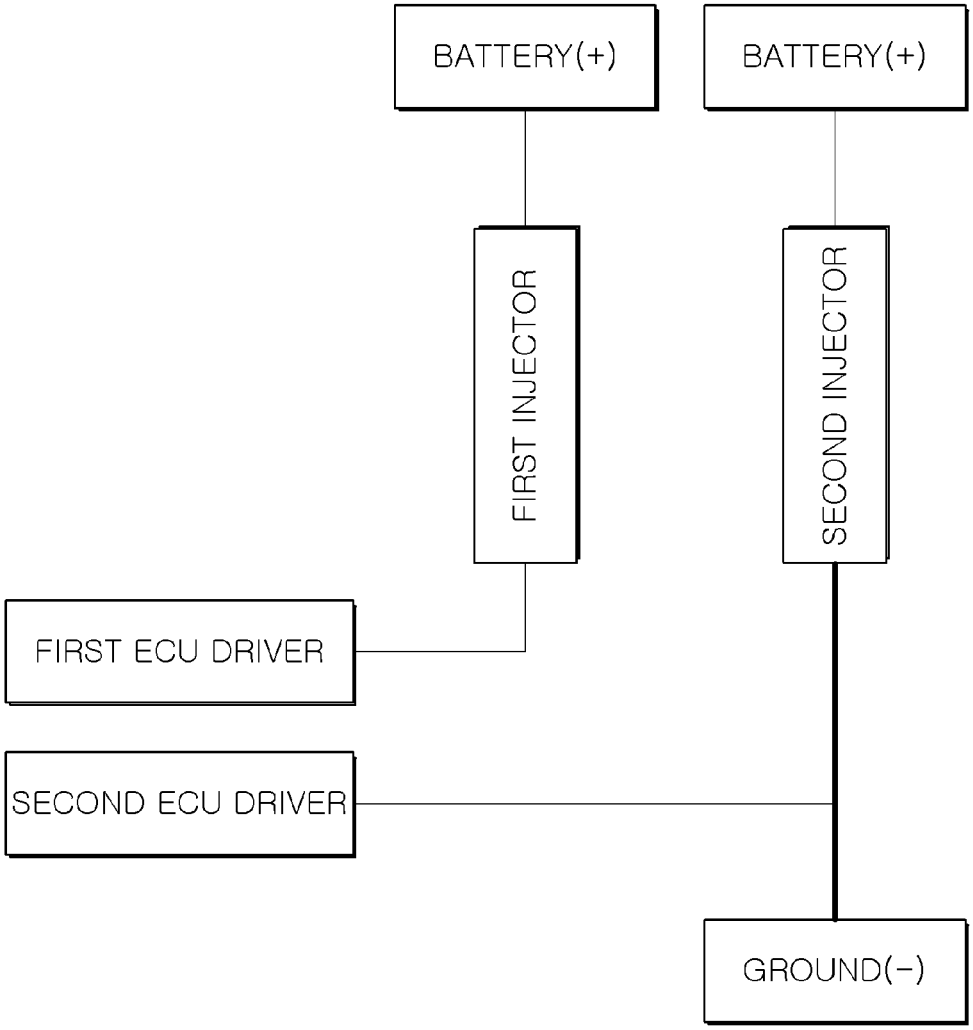

FIGS. 3A to 3C illustrate exemplary causes of electrical failures that may occur in the injectors 10. FIG. 3A illustrates a short circuit between a battery and an ECU driver; FIG. 3B illustrates an open circuit between an ECU driver and an injector controlled by the ECU driver; and FIG. 3C illustrates a short circuit between an injector and a ground terminal.

The MPi engine performs ground control at active low when controlling the opening or closing of an injector. Thus, when a short circuit occurs between an injector and a ground terminal, as illustrated in FIG. 3C, an injector valve in which the corresponding electrical failure has occurred remains in an open state. Thus, even when an electrical failure has occurred only one of the injectors, the ECU cuts off the fuel supply to the entire corresponding cylinder, at steps S120 and S180.

When the ECU determines that either a short circuit has occurred between the battery and the ECU driver or an open circuit occurred between the ECU driver and an injector controlled by the ECU driver as illustrated in FIG. 3A or 3B, the ECU enters the fail safe mode to perform fuel injection control using only a normal injector, at steps S140 and S170.

In the embodiment, the ECU compares the total amount of fuel required by the corresponding cylinder to the maximum fuel injection flow rate of the normal injector at step S160. According to the comparison result, the ECU decides whether or not to cut off the fuel supply to all injectors.

Injectors used in an example embodiment of the dual port injector system have a smaller static flow rate than an MPi system injector used in an engine having the same displacement. Therefore, in a typical idle region or partial load region, the total amount of fuel required by the corresponding cylinder can be supplied by a single normal injector. In a specific engine load region, that is, a high load region of the engine, however, the flow rate of the normal injector cannot cope with the total amount of fuel required by the corresponding cylinder.

Thus, when the total amount of fuel required by the corresponding cylinder is greater than the maximum amount of fuel that can be supplied only through the normally operating injector, the ECU cuts off the fuel supply to all injectors in the corresponding cylinder at step S180. Furthermore, when the flow rate of the normally operating injector can cope with the total amount of fuel required by the corresponding cylinder in the corresponding operation region such as high load operating region, middle load operating region of engine and etc., the ECU cuts off the fuel supply to the injector in which an electrical failure has occurred, and increases the amount of fuel injected by the normally operating injector such that the required amount of fuel can be supplied to the corresponding cylinder, at step S170.

In the embodiment, when entering the fail safe mode at step S150, the ECU performs operation control and enters a limp home mode in which the torque and engine RPM are limited.

Because the static flow rate of the injector used in the dual port injector system is much lower than the static flow rate of an MPi system injector used in an engine having the same displacement and the injection time of the corresponding cylinder needs to be doubled, the air volume (torque) and the engine RPM or the fuel amount needs to be limited. Therefore, when the fail safe mode is performed due to an electrical failure of an injector, the ECU may perform operation control and enter the limp home mode in which the torque or engine RPM is limited.

In accordance with the present invention, when an electrical failure occurs in only one of the injectors in a dual port injector engine, the ECU may increase the amount of fuel injected by the normal injector, and prevent a rapid reduction of torque, thereby enabling a driver to safely drive to a repair shop without feeling a sense of incompatibility. Thus, high operational stability can be secured.

Furthermore, even when an injector failure occurs, a stable fuel air ratio may be provided through the fail-safe mode, making it possible to minimize the damage of the catalytic converter.

While the present invention has been described with respect to the specific embodiments, it will be apparent to those skilled in the art that various changes and modifications may be made without departing from the spirit and scope of the invention as defined in the following claims.

What is claimed is:

1. A method for controlling a plurality of injectors installed in a cylinder of an engine for supplying fuel to the cylinder, the cylinder requiring an amount of fuel to be injected by the injectors, the method comprising:

determining whether an electrical failure has occurred in any injector of the plurality of injectors; and entering a fail-safe mode when an electrical failure has occurred in one of the plurality of injectors, wherein in the fail-safe mode fuel supply is cut off to the injector that has experienced an electrical failure, and an amount of fuel injected into the cylinder by a normally operating injector is increased, and wherein entering the fail-safe mode further comprises:

determining the cause of the electrical failure; and depending on the cause of the electrical failure, deciding whether to cut off the fuel supply to the injector that has experienced an electrical failure and to perform injection control for that injector.

2. The method of claim 1, wherein when the amount of fuel required by the cylinder is equal to or more than a flow rate of the normally operating injector, fuel supply to all injectors in the same cylinder is cut off.

3. The method of claim 1, wherein when the cause of the electrical failure is a short circuit between the injector and a ground, fuel supply to all injectors is cut off.

4. The method of claim 1, wherein when the cause of the electrical failure is either a short circuit between an ECU driver and a battery or an open circuit between the ECU driver and one of the injectors, the fuel supply to the injector that has experienced an electrical failure is cut off, and the amount of fuel injected by the normally operating injector is increased, in order to perform injection control.

5. The method of claim 1, wherein when it is determined that electrical failures have occurred in all injectors in the same cylinder, fuel supply to all injectors is cut off.

6. The method of claim 1, wherein in the fail-safe mode, the engine is operated in a limp home mode in which torque and engine RPM are limited.

* * * * *